US007159287B2

(12) United States Patent
Parker et al.

(10) Patent No.: US 7,159,287 B2
(45) Date of Patent: Jan. 9, 2007

(54) MEMORIALIZATION CASKET

(75) Inventors: Daniel J. Parker, Connersville, IN (US); Jamie D. Riddle, Sunman, IN (US); Greg Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 85 days.

(21) Appl. No.: 10/755,613

(22) Filed: Jan. 12, 2004

(65) Prior Publication Data

US 2004/0211042 A1 Oct. 28, 2004

(51) Int. Cl.
*A61G 17/00* (2006.01)

(52) U.S. Cl. ..... 27/19

(58) Field of Classification Search ..... 27/14, 27/19, 2; D99/8, 10, 12
See application file for complete search history.

(56) References Cited

U.S. PATENT DOCUMENTS

| | | | | |
|---|---|---|---|---|
| 586,071 | A | | 7/1897 | Loomis |
| 1,192,169 | A | | 7/1916 | DeCamp |
| 1,931,828 | A | | 10/1933 | Overstreet |
| 4,222,189 | A | | 9/1980 | Kamei |
| 4,324,026 | A | | 4/1982 | Craft |
| 4,357,741 | A | | 11/1982 | Winburn et al. |
| 4,457,054 | A | | 7/1984 | Craft et al. |
| 5,495,648 | A | | 3/1996 | Rojdev et al. |
| 5,611,124 | A | | 3/1997 | Biondo et al. |
| 5,636,419 | A | * | 6/1997 | Foye ..... 27/19 |
| 5,675,876 | A | | 10/1997 | Benedict et al. |
| 5,678,289 | A | | 10/1997 | Saaf |
| 5,727,291 | A | | 3/1998 | Biondo et al. |
| D418,961 | S | | 1/2000 | Biondo et al. |
| D424,779 | S | * | 5/2000 | Agee et al. ..... D99/1 |
| D435,158 | S | * | 12/2000 | Biondo ..... D99/10 |
| D435,954 | S | * | 1/2001 | Biondo ..... D99/10 |
| 6,237,202 | B1 | | 5/2001 | Agee et al. |
| 6,324,736 | B1 | | 12/2001 | Atrio |

* cited by examiner

*Primary Examiner*—William L. Miller
(74) *Attorney, Agent, or Firm*—Wood, Herron & Evans, LLP

(57) ABSTRACT

A memorialization casket comprises a shell, a lid closable upon the shell and an alcove structure mounted to an under side of the lid. The casket lid may include a dish mounted to the under side of the casket lid, with the alcove structure being mounted to the dish. The dish may have a panel which may include an opening, with the alcove structure mounted in the opening. An alcove structure mounting adaptor may be mounted in the opening, with the alcove structure being mounted to the adaptor. The mounting adaptor may include a fastener fastening the alcove structure to the mounting adaptor. The alcove structure may include a fastener adapted to removably retain the ornament in the alcove structure. The dish may include a one piece cap panel with the alcove structure integrally formed in the cap panel. A one piece dish may include a cap panel, puffing members, and alcove structure integrally formed with each other in a unitary structure.

12 Claims, 5 Drawing Sheets

MEMORIALIZATION CASKET

FIELD OF THE INVENTION

This invention relates generally to the death care industry, and more particularly to personalized caskets for memorializing a deceased.

BACKGROUND OF THE INVENTION

Upon the death of a family member the surviving loved one of the deceased must make a number of decisions, including what type of funeral or other memorial service to hold, preparation of the body, selection of a suitable casket or cremation urn, etc. In the death care industry it is conventional for those decisions to be made in a so-called "arrangement conference." In an arrangement conference, the funeral director meets with the surviving loved one of the deceased, typically in the funeral home of the funeral director, and describes to and discusses with the surviving loved one the various funeral products and services which are available. The funeral director may use visual aids such as a product catalog, product display board (such as that disclosed in the assignee's U.S. Pat. No. 5,787,626 titled Funeral Product Display Case hereby incorporated by reference herein) and a casket selection room (such as that disclosed in the assignee's U.S. Pat. No. 5,405,017 titled Modular Casket Display System and in the assignee's pending application Ser. No. 09/638,576 titled Display For A Casket Selection and/or Viewing Room both hereby incorporated by reference herein) to illustrate the products available to the customer.

There is a trend in the death care industry to make efforts towards "personalizing" the funeral products and the funeral or other memorial service purchased for the deceased to provide a more meaningful memorial experience for the family and friends of the deceased. One of the earlier attempts at providing a means of personalizing or customizing a casket to the deceased may be seen with reference to the assignee's U.S. Pat. No. 4,457,054 titled Casket Shelf, hereby incorporated by reference herein. That patent discloses a casket shelf which is mounted to the dish assembly of the head end cap when the head end cap is in the open position. The shelf provides a surface for supporting and displaying articles of religious or personal significance to the deceased.

Many casket manufacturers and funeral directors now manufacture and offer many "custom modular" variations of caskets, rather than selling mere "cookie cutter" or "one size fits all" caskets, thereby allowing the loved one to in essence design a specific casket especially suited or tailored to the deceased. For example, customers can select from a number of casket materials, casket finishes, casket corner adornments and casket interiors. Advances made in the area of "quick change" and "tool less" fastening mechanisms have greatly facilitated the rapid removal of one accessory from the casket and the rapid installation of another more desirable accessory to the casket. In addition to promoting personalization of the casket to the deceased, such interchangeability greatly reduces the amount of inventory the funeral director must keep on hand. An example may be seen in the assignee's U.S. Pat. No. 6,591,446 titled Quick Change Casket Corner Attachment Mechanism and hereby incorporated by reference herein, commercially available as the LifeSymbols® line of interchangeable corner adornments available from Batesville®.

The "custom" casket interiors available to the funeral customer today include not only the internal lining material of the casket (which itself may also be of the quick-change type, see the Assignee's U.S. Pat. No. 5,784,768 titled Casket Having Quickly Interchangeable And Adjustable Interior and hereby incorporated by reference herein) but also the decorative cap panels that fit within the underneath of the casket cap which serve to present a visually aesthetically pleasing appearance to the underside of the cap when in the open position. The cap panel can be embroidered with a favorite saying of the deceased, a scene depicting the deceased's hobby, etc. Special cap panels have even been designed which, in addition to performing a memorial function while installed in the casket, are adapted to be presented to the loved one surviving the deceased to be displayed by the loved one in his or her home as a keepsake. See U.S. Pat. No. 6,237,202 titled Dish Assembly For A Burial Casket Cap assigned to the assignee of the present invention and hereby incorporated by reference herein, the subject of which is commercially available as the MemoryFrame™ line of cap panels available from Batesville®. The casket can also include a memorabilia drawer in which keepsakes of the deceased can be stored and displayed, as disclosed in the assignee's U.S. Pat. No. 5,611,124 titled Casket Having Memorabilia Compartment and hereby incorporated by reference herein, commercially available as the MemorySafe® line of caskets including memorabilia drawers available from Batesville®.

Advances have therefore been made in the area of "personalization" of funeral products as demonstrated with the novel products discussed above. However, there continues to be room for improvement in the area of personalization in the death care industry.

SUMMARY OF THE INVENTION

The present invention is a memorialization casket of the type which allows it to be personalized to the deceased. The casket comprises a shell, a lid closable upon the shell and an alcove structure mounted to an under side of the lid, the alcove structure including a recessed area adapted to receive an ornament for display.

The casket lid may include a dish mounted to the under side of the casket lid, with the alcove structure being mounted to the dish. The dish may comprise a rectangular panel having a puffing member secured to each side of the rectangular panel. The panel of the dish may include an opening therethrough, with the alcove structure mounted in the opening of the dish panel. The alcove structure may comprise a floor, a pair of side walls, a back wall and a roof. The alcove structure roof may be attractively arcuately shaped. The alcove structure may include a decorative flange extending from the floor, side walls and roof, which faces a portion of the dish panel around the dish panel opening.

The casket of this invention may further comprise an alcove structure mounting adaptor mounted in the dish panel opening, with the alcove structure being mounted to the adaptor. The alcove structure mounting adaptor may comprise a back wall and a flange, the flange being secured to the dish panel. The mounting adaptor may further include a fastener secured thereto, the fastener fastening the alcove structure to the mounting adaptor. The fastener may be secured to the back wall of the mounting adaptor and to the back wall of the alcove structure. The fastener may be double sided tape.

The back wall of the alcove structure may include a fastener adapted to removably retain the ornament in the alcove structure. The alcove structure fastener may be at least one keyhole adapted to receive therein a stud with a head on the free end thereof, secured to the ornament.

In another aspect of the present invention, the alcove structure may be integrally formed in the cap panel, for example, by a molding process, to provide a one piece cap panel that includes the alcove structure. The alcove structure may comprise a floor, a pair of side walls, a back wall and a roof. The alcove structure roof may be attractively arcuately shaped. The alcove structure may include a decorative flange extending from the floor, side walls and roof. The back wall of the alcove structure may include a fastener adapted to removably retain the ornament in the alcove structure. The alcove structure fastener may be at least one keyhole adapted to receive therein a stud with a head on the free end thereof, secured to the ornament.

In yet another aspect of the present invention, the alcove structure of the above construction may be integrally formed in a one piece dish mounted to the underside of the casket lid. In this aspect, the dish comprises a generally rectangular panel, puffing members and alcove structure formed integral with each other through, for example, a molding process.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
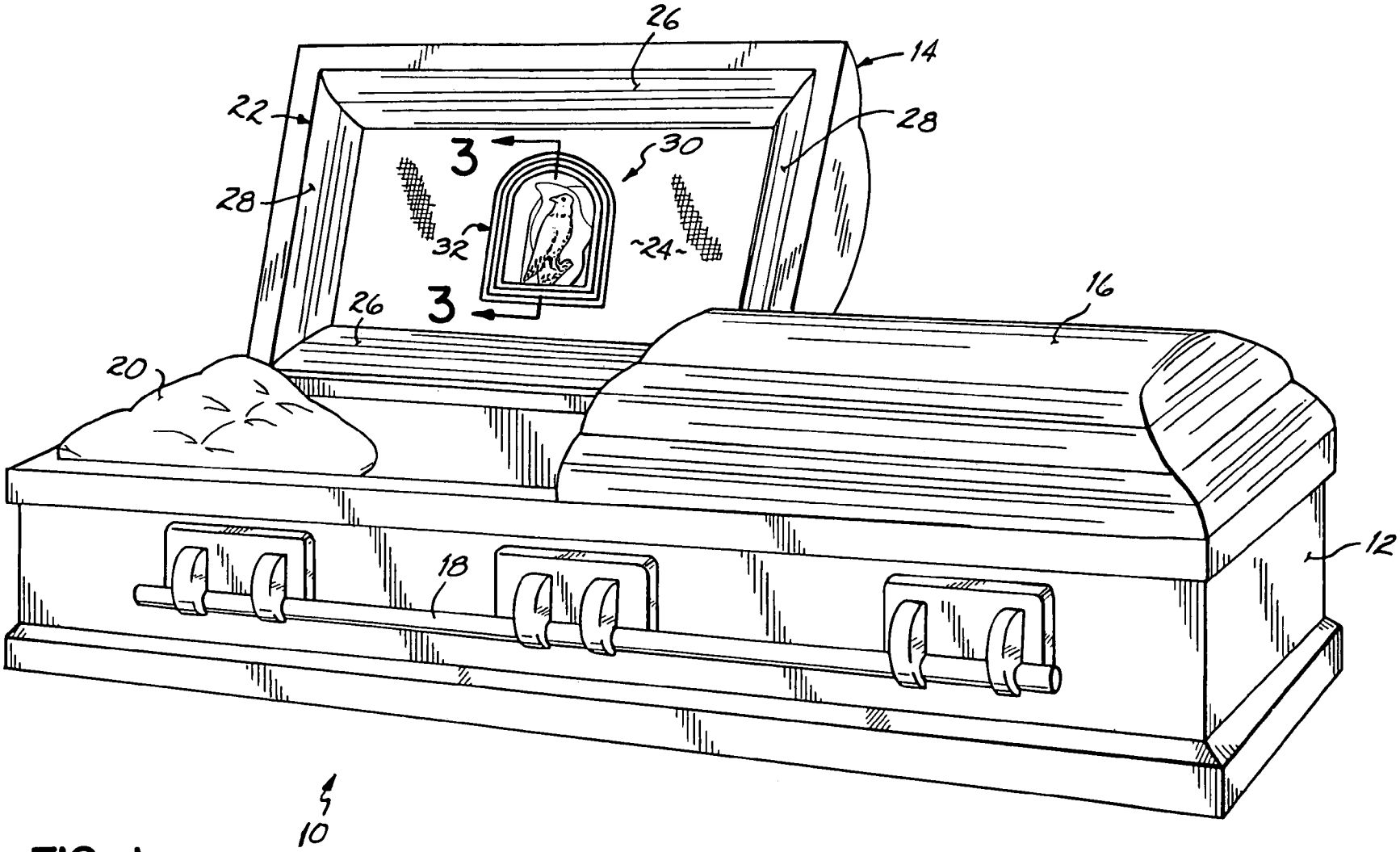
FIG. 1 is a perspective view of a casket including a head end cap dish with an alcove structure and an ornament displayed in the alcove structure, according to the principles of the present invention.

With reference to FIG. 1, there is illustrated a casket 10 according to the present invention. The casket 10 includes a lower body containing portion or shell 12, a head end cap 14 pivoted to a rear upper edge of the shell 12 and a foot end cap 16 likewise pivoted to the rear upper edge of the shell 12. Casket 10 may include handling apparatus 18 and interior trim 20 as is known in the art.

Referring now to all the Figures, the head end cap 14 may include a dish 22 mounted into an underside of head cap 14 in a manner known to those skilled in the art. Dish 22 may include a rectangular cap panel 24 having two pairs of opposing puffing members attached thereto, opposed side puffing members 26, 26 and opposed end puffing members 28, 28. An ornament display assembly 30 may be positioned preferably centrally of the panel 24.

Figure 2:
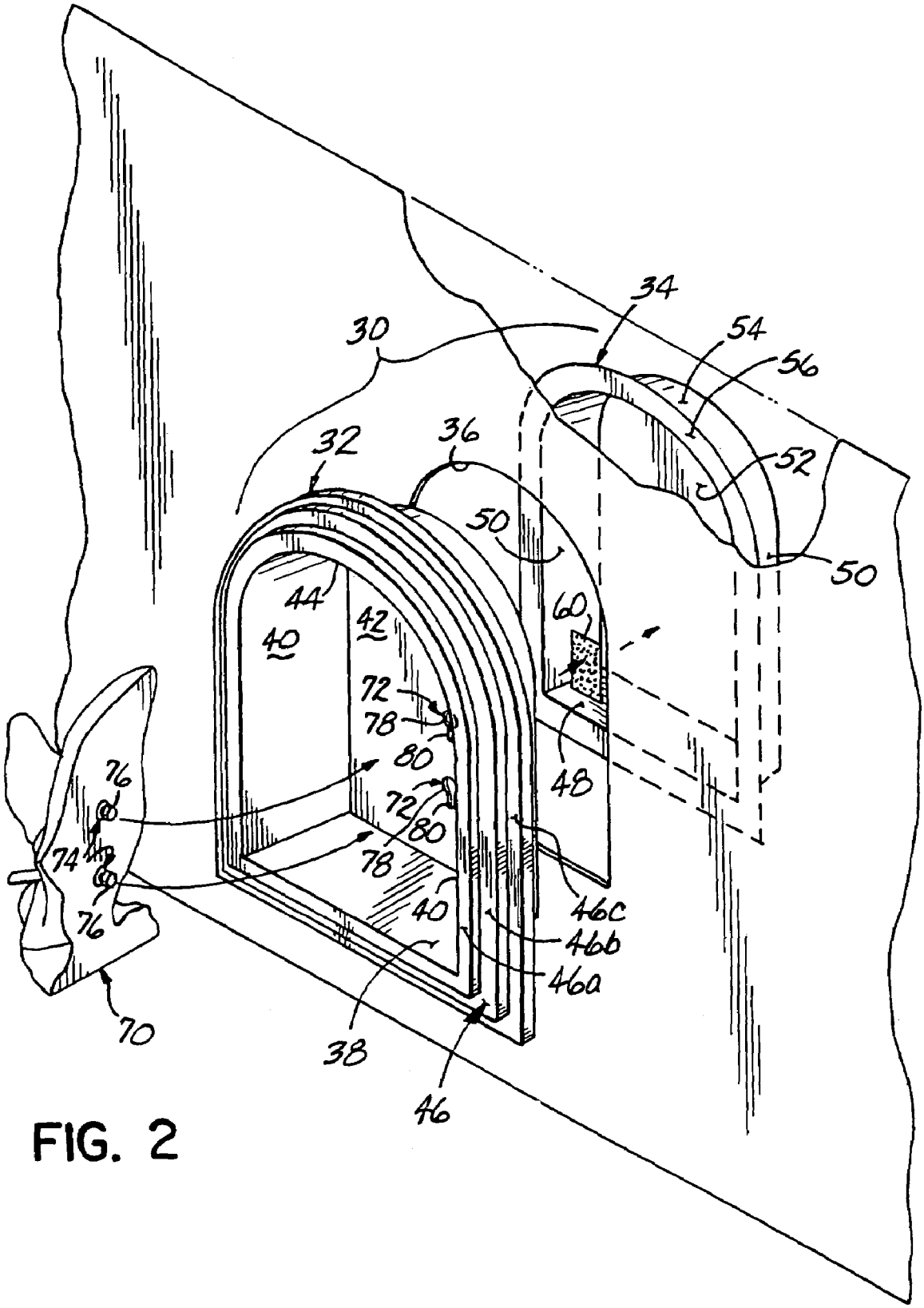
FIG. 2 is a disassembled perspective view, enlarged, of the dish and alcove structure of FIG. 1.
Figure 3:
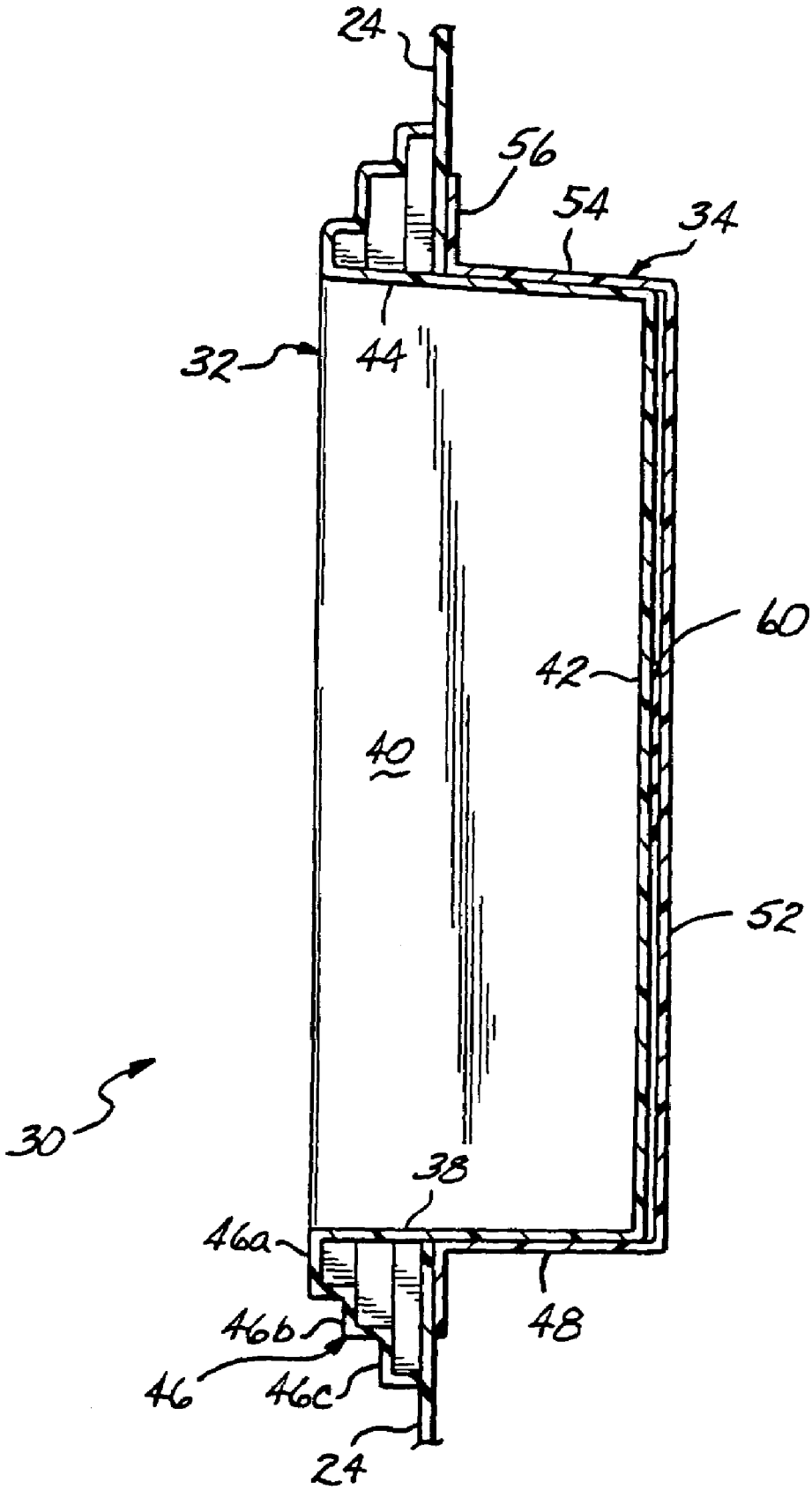
FIG. 3 is a view taken along line 3—3 of FIG. 1.

Referring now to FIGS. 2 and 3, the ornament display assembly 30 is shown in more detail. The display 30 may comprise, generally, an alcove structure 32 and a mounting adaptor 34 facilitating mounting of the alcove structure 32 to the panel 24. The panel 24 may include an opening 36 therein in which the alcove structure 32 is mounted. Alcove structure 32 may comprise a floor 38, a pair of opposed side walls 40, 40, a back wall 42 and a roof 44. The roof 44 of the alcove structure 32 may preferably be arcuately shaped for aesthetics. The alcove structure 32 may further comprise a flange 46 extending from the floor 38, side walls 40, 40 and roof 44. Flange 46 may be decorative and may have, as one example, steps 46*a*, 46*b* and 46*c*. Flange 46 faces panel 24 around a periphery of panel opening 36 and, as illustrated, abuts panel 24.

As first mentioned above, mounting adapter 34 facilitates mounting of alcove structure 32 to panel 24. Mounting adapter 34 may comprise a floor 48, a pair of opposed side walls 50, 50, a back wall 52 and a roof 54. The mounting adapter 34 may further comprise a flange 56 extending from the floor 48, side walls 50, 50 and roof 54. Mounting adapter 34 may preferably be of a size and geometry to permit alcove structure 32 to nestably fit within mounting adapter 34. To secure mounting adapter 34 to panel 24 flange 56 may be secured thereto with any suitable fastening means such as adhesive, staples, double-sided tape, by sewing, etc. As illustrated, flange 56 is secured to a back side of panel 24; however, it is to be appreciated that flange 56 could as well be secured to a front side of panel 24 if desired or required.

To removably secure alcove structure 32 to mounting adapter 34 a suitable fastening means such as double-sided tape 60 may be employed. Double-sided tape 60 may be adhered to the front side of back wall 52 of mounting adapter 34 and to the back side of back wall 42 of alcove structure 32 to removably secure the same together.

FIG. 2 illustrates an ornament 70 for removable securement to alcove structure 32. To removably secure ornament 70 to alcove structure 32 a suitable fastening means may be employed, such as the illustrated pair of key holes 72, 72 in rear wall 42 of alcove structure 24 in conjunction with a pair of studs 74, 74 secured to a rear side of ornament 70, which studs 74, 74 include heads 76, 76 on free ends thereof. Thus, to removably install ornament 70 in alcove structure 32 heads 76 of studs 74 are pushed through circular portions 78 of key holes 72 and then pushed downwardly such that heads 76 are retained by narrow slot portions 80 of key holes 72. In the event that double-sided tape 60 is of the foamed variety, the space between walls 52 and 42 should be sufficient so as to accommodate heads 76 of studs 74. If using a thin piece of double-sided tape, or a bead of adhesive, keyhole slots 72 may be required in both the walls 52 and 42. Further details of a similar mounting technique utilized to mount an ornament to a casket corner may be seen with reference to the assignee's prior-mentioned U.S. patent application Ser. No. 09/660,574.

It is contemplated that ornament 70 may be generally of the three-dimensional sculpture type or the like. It is further contemplated that a funeral director would have a number of different designs of ornaments 70 on hand from which a customer might choose. If desired ornament 70 could be identical to the ornaments mounted to the corners of the casket. An example of a casket corner ornament may be seen with reference to the assignee's U.S. Design Pat. No. Des. 418,961 titled Casket Ornament, hereby incorporated by reference herein.

Figure 4:
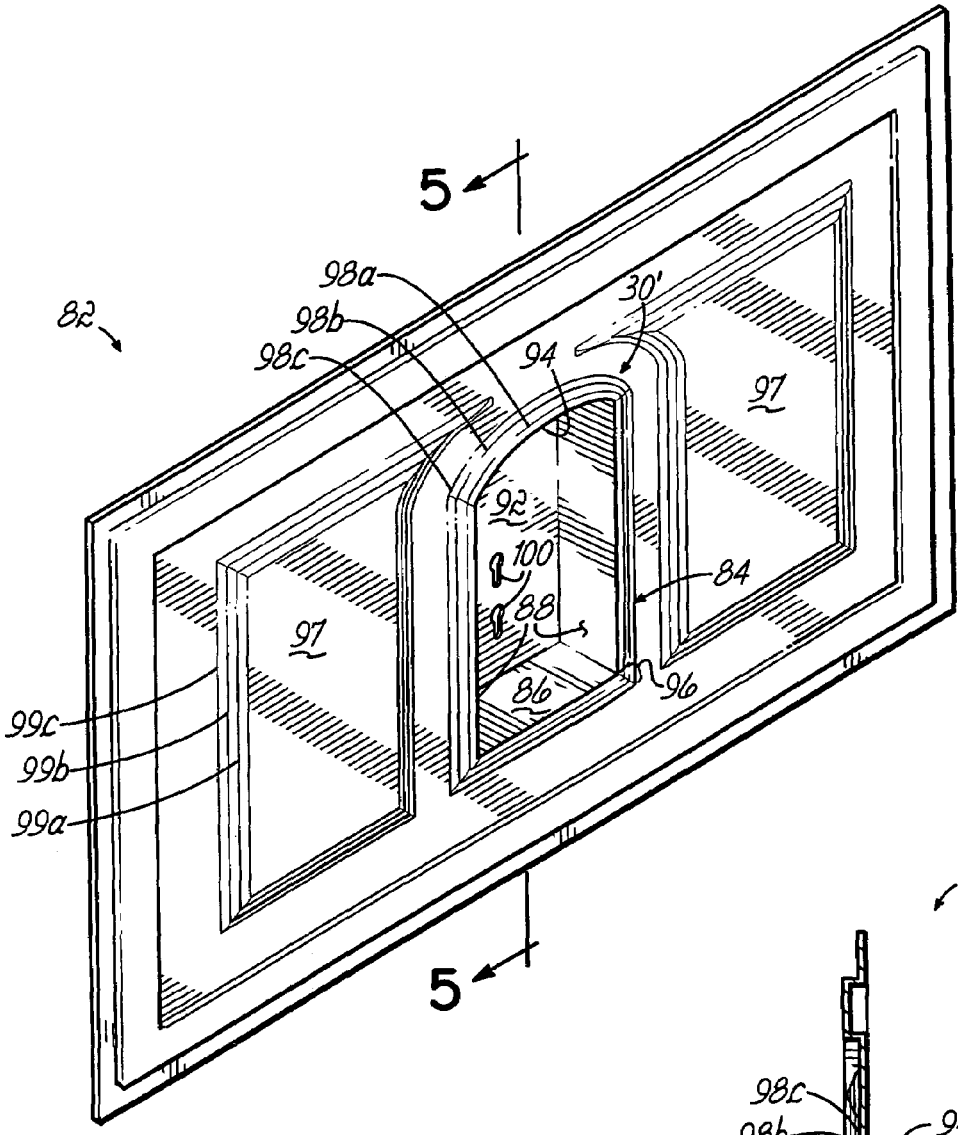
FIG. 4 is a perspective view of a one piece cap panel having the alcove structure integrally formed in the cap panel.
Figure 5:
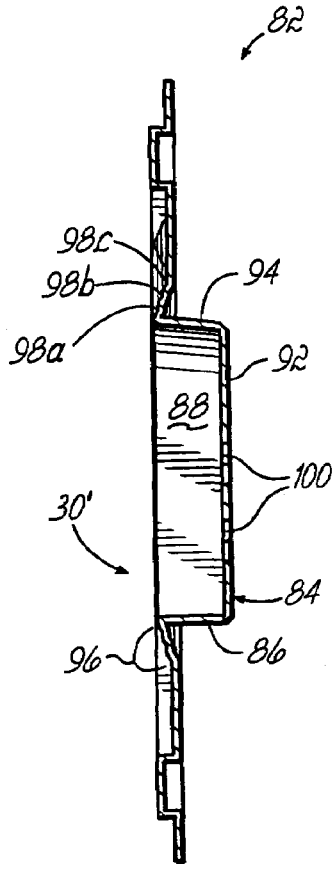
FIG. 5 is a view taken along line 5—5 of FIG. 4.

Referring now to FIGS. 4 and 5, an ornamental display assembly 30 ' may be formed integral to the cap panel to form a one piece cap panel 82 having the alcove structure 84 formed therein. The one piece cap panel 82 can be formed from a plastic by, for example, a molding process such as compression molding or injection molding. The alcove structure 84 may comprise a floor 86, a pair of opposed side walls 88, 88, a back wall 92 and a roof 94. The roof 94 of the alcove structure 84 may prefereably be arcuately shaped for aesthetics. The alcove structure 84 may further comprise a flange 96 extending from the floor 86, side walls 88, 88 and roof 94. Flange 96 may be decorative and may have, as one example, steps 98*a*, 98*b*, and 98*c*. The one piece cap panel 82 may further include other decorative features, such as raised lateral portions 97 formed in the one piece cap panel 82, each having decorative steps 99*a*, 99*b*, and 99*c* complimenting those of alcove structure 84.

An ornament 70 (FIG. 2) may be removably secured to alcove structure 84. To removably secure ornament 70 to alcove structure 84 a suitable fastening means may be employed, such as the illustrated pair of key holes 100, 100 in rear wall 92 of alcove structure 84 in conjunction with a pair of studs 74, 74 secured to the rear side of ornament 70, which studs 74, 74 include heads 76, 76 on free ends thereof. Ornament 70 is removably secured to the alcove structure 84 in the same manner as shown in FIG. 2.

Figure 6:
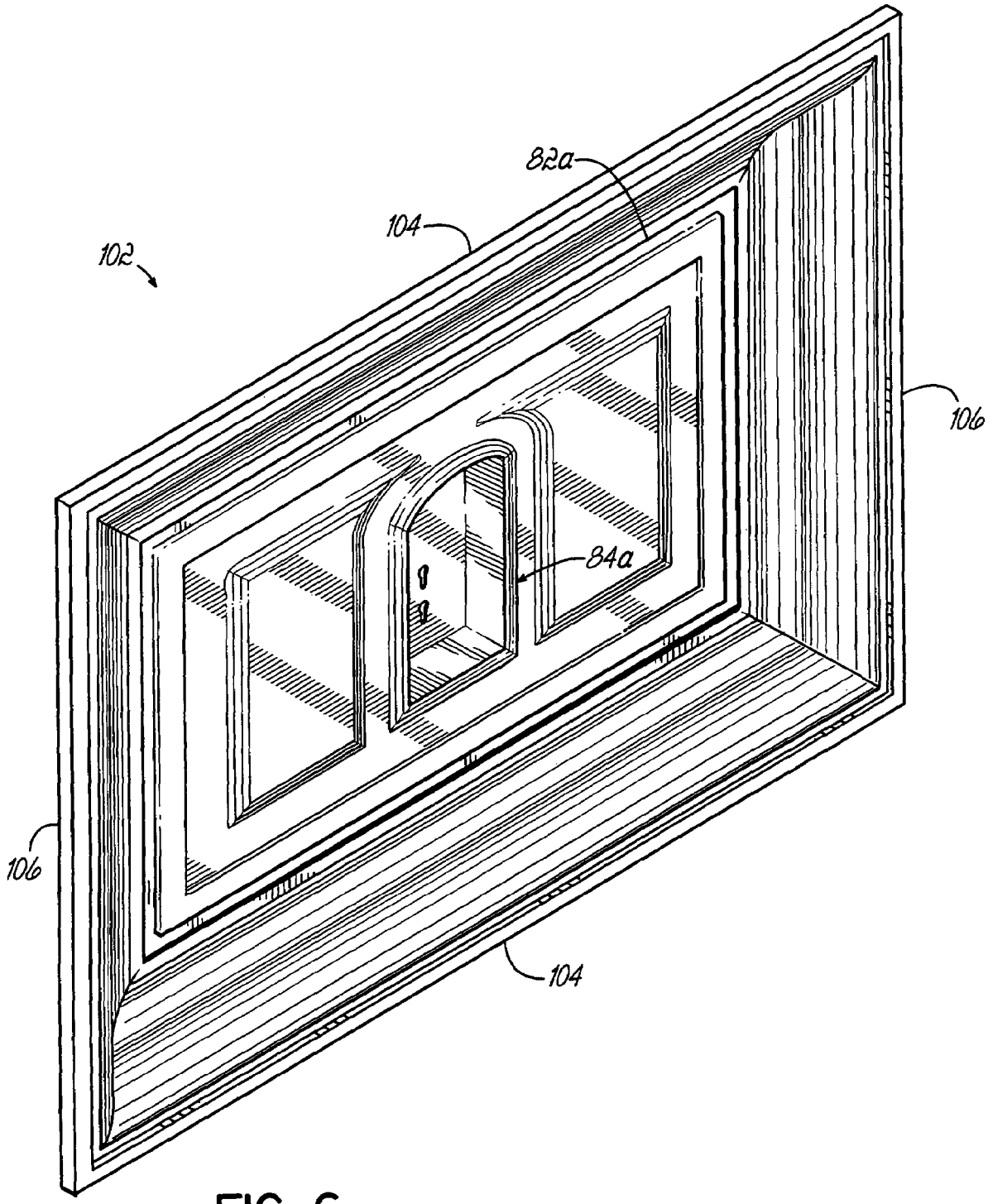
FIG. 6 is a perspective view of a one piece dish having the alcove structure integrally formed in the dish.

Referring to FIG. 6, a one piece dish 102 may be formed where the one piece cap panel 82(*a*), similar to that shown in FIGS. 4–5 and described above, is formed integral with two pairs of opposing puffing members, opposed side puffing members 104, 104 and opposed end puffing members 106, 106. The puffing members 104, 104, 106, 106, cap panel 82(*a*), and alcove structure 84(*a*) then form a one piece dish 102 mountable to an underside of head cap 14. The one piece dish 102 can be formed from a plastic by, for example, a molding process such as compression molding or injection molding.

Those skilled in the art will readily recognize numerous adaptations and modifications which can be made to the present invention which will result in an improved memorialization casket, yet all of which will fall within the spirit and scope of the present invention as defined in the following claims. For example, while not illustrated in the drawings, the dish 22 could include a decorative cap panel insert which is installed in the dish 22 and held there by a friction hit within puffing members 26, 26 and 28, 28. In that case the cap panel insert would need to include an opening therethrough through which the alcove structure 32 could be viewed and/or installed. Accordingly, the invention is to be limited only by the scope of the following claims and their equivalents.

What is claimed is:

1. A casket comprising:

a shell;

a lid closeable upon said shell; and a dish mounted to the underside of said casket lid, said dish comprising:

a one piece cap panel, said cap panel including an alcove structure integrally formed in said cap panel; and, a puffing member secured to each side of said cap panel; and wherein said cap panel is molded, said alcove structure molded in said cap panel; and wherein said alcove structure comprises:

a floor;

a pair of side walls;

a back wall; and a roof.

2. The casket of claim 1 wherein said alcove structure roof is arcuately shaped.

3. The casket of claim 2 wherein said alcove structure includes a decorative flange extending from said floor, side walls and roof, said flange formed in said cap panel.

4. The casket of claim 1 wherein said back wall of said alcove structure includes a fastener adapted to removably retain an ornament in said alcove structure.

5. The casket of claim 4 wherein said alcove structure fastener is at least one key hole adapted to receive therein a stud with a head on a free end thereof, secured to the ornament.

6. A casket comprising:

a shell;

a lid closeable upon said shell; and a one piece dish mounted to the underside of said casket lid, said dish comprising;

a cap panel, said cap panel including an alcove structure integrally formed in said cap panel; and, a puffing member secured to each side of said cap panel, said puffing members and said cap panel integrally formed with each other.

7. The casket of claim 6 wherein said cap panel, said puffing members and said alcove structure are molded integral with each other.

8. The casket of claim 7 wherein said alcove structure comprises:

a floor;

a pair of side walls;

a back wall; and a roof.

9. The casket of claim 8 wherein said alcove structure roof is arcuately shaped.

10. The casket of claim 9 wherein said alcove structure includes a decorative flange extending from said floor, side walls and roof, said flange formed in said cap panel.

11. The casket of claim 8 wherein said back wall of said alcove structure includes a fastener adapted to removably retain an ornament in said alcove structure.

12. The casket of claim 11 wherein said alcove structure fastener is at least one key hole adapted to receive therein a stud with a head on a free end thereof, secured to the ornament.

* * * * *